US009011556B2

(12) United States Patent
Schwab

(10) Patent No.: US 9,011,556 B2
(45) Date of Patent: Apr. 21, 2015

(54) FUEL COMPOSITION CONTAINING A HYDROCARBYL-SUBSTITUTED SUCCINIMIDE

(75) Inventor: Scott D. Schwab, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 459 days.

(21) Appl. No.: 11/684,152

(22) Filed: Mar. 9, 2007

(65) Prior Publication Data

US 2008/0216394 A1 Sep. 11, 2008

(51) Int. Cl.

| | |
|---|---|
| ***C10L 1/22*** | (2006.01) |
| ***C10L 10/08*** | (2006.01) |
| ***C10L 1/224*** | (2006.01) |
| ***C10L 1/2383*** | (2006.01) |

(52) U.S. Cl.

CPC ..... *C10L 10/08* (2013.01); *C10L 1/224* (2013.01); *C10L 1/2383* (2013.01)

(58) Field of Classification Search

USPC ..... 44/398, 301, 337, 325; 508/192, 460, 508/518, 187; 123/1 A; 560/67

See application file for complete search history.

(56) References Cited

U.S. PATENT DOCUMENTS

| | | | | |
|---|---|---|---|---|
| 3,172,892 | A | 3/1965 | Le Suer et al. | |
| 3,202,678 | A | 8/1965 | Stuart at al. | |
| 3,216,936 | A | 11/1965 | Le Suer et al. | |
| 3,219,666 | A | 11/1965 | Norman et al. | |
| 3,254,025 | A | 5/1966 | Le Suer et al. | |
| 3,272,746 | A | 9/1966 | Le Suer et al. | |
| 3,361,673 | A | 1/1968 | Stuart et al. | |
| 3,676,089 | A | 7/1972 | Morris et al. | |
| 4,152,499 | A | 5/1979 | Boerzel et al. | |
| 4,234,435 | A | 11/1980 | Meinhardt et al. | |
| 4,240,803 | A | 12/1980 | Andress, Jr. | |
| 4,482,356 | A | 11/1984 | Hanlon | |
| 4,605,808 | A | 8/1986 | Samson | |
| 4,613,341 | A * | 9/1986 | Zaweski et al. | 44/325 |
| 4,968,321 | A * | 11/1990 | Sung et al. | 44/337 |
| 5,358,651 | A * | 10/1994 | Walsh | 508/290 |
| 5,393,309 | A | 2/1995 | Cherpeck | |
| 5,575,823 | A | 11/1996 | Wallace et al. | |
| 5,620,486 | A | 4/1997 | Cherpeck | |
| 6,606,856 | B1 | 8/2003 | Brown et al. | |
| 6,648,929 | B1 | 11/2003 | Daly et al. | |
| 6,719,814 | B1 * | 4/2004 | Lin | 44/398 |
| 2003/0096713 | A1 * | 5/2003 | Schnur et al. | 508/192 |
| 2003/0177692 | A1 * | 9/2003 | Arters et al. | 44/418 |
| 2004/0139931 | A1 | 7/2004 | Duncan et al. | |
| 2005/0039381 | A1 | 2/2005 | Langer et al. | |
| 2005/0120619 | A1 * | 6/2005 | Koch et al. | 44/301 |
| 2007/0179070 | A1 * | 8/2007 | Kurihara et al. | 508/460 |
| 2008/0289249 | A1 | 11/2008 | Hou et al. | |
| 2009/0149358 | A1 | 6/2009 | Rhoads et al. | |

FOREIGN PATENT DOCUMENTS

| | | | |
|---|---|---|---|
| CA | 1148925 | A1 | 6/1983 |
| CA | 2420818 | | 9/2003 |
| CA | 2492982 | | 8/2005 |
| EP | 0 020 037 | | 12/1980 |
| EP | 0889111 | | 1/1999 |
| EP | 1116779 | | 7/2001 |
| EP | 1151994 | | 11/2001 |
| EP | 1348754 | | 10/2003 |
| EP | 1424322 | | 6/2004 |
| EP | 1669433 | | 6/2006 |
| JP | 5626996 | A | 3/1981 |
| JP | 2003268392 | | 9/2003 |
| WO | 9623855 | | 8/1996 |
| WO | 9966010 | | 12/1999 |
| WO | 0138462 | | 5/2001 |
| WO | 0206428 | | 1/2002 |
| WO | 02077130 | | 10/2002 |
| WO | 03070860 | | 8/2003 |
| WO | 2006063161 | | 6/2006 |
| WO | 2007070360 | | 6/2007 |

OTHER PUBLICATIONS

Albemarle Corporation "16 ASA Alkenyl Succinic Anhydride" 2005.*

Japanese Office Action dated Jun. 25, 2013, Japanese Application No. 2012-156678, filed Jul. 12, 2012, 8 pages (including translation).

* cited by examiner

*Primary Examiner* — Prem C Singh

*Assistant Examiner* — Chantel Graham

(74) *Attorney, Agent, or Firm* — Fitch, Even, Tabin & Flannery LLP; Dennis Rainear

(57) ABSTRACT

The present disclosure is directed to a middle distillate fuel composition comprising a friction modifying effective amount of a hydrocarbyl-substituted succinimide derived from maleic anhydride, polyisobutylene and ammonia; and a middle distillate fuel. A method for modifying friction in a compression engine comprising providing to the engine the disclosed fuel composition is also disclosed. Moreover, there is disclosed a method for improving fuel mileage.

6 Claims, No Drawings

FUEL COMPOSITION CONTAINING A HYDROCARBYL-SUBSTITUTED SUCCINIMIDE

FIELD OF THE DISCLOSURE

The present disclosure relates to a low-sulfur fuel composition comprising a friction modifying effective amount of a hydrocarbyl-substituted succinimide; and a low-sulfur fuel. There is also disclosed a method for modifying the friction in an engine.

BACKGROUND OF THE DISCLOSURE

In order to conserve energy, automobiles are now being engineered to give improved mileage compared to those in recent years. This effort is of great urgency in the United States in view of regulations which compel auto manufacturers to achieve prescribed mileage. In an effort to achieve the required mileage and fuel economy, new cars are being downsized and made much lighter.

EP 0 020 037 discloses that the use of an oil-soluble, $C_{12-36}$ aliphatic hydrocarbyl succinimide or succinimide provides a friction reducing effect when it is incorporated into a lubricating oil, such as for use in a crankcase. The hydrocarbyl succinic anhydride is reacted with ammonia to form the succinimide. The reference discloses that the succinimide can also be used in both diesel fuel and gasoline. However, the reference does not teach that the succinimide can be used in low-sulfur fuel compositions. In fact, the reference is silent with respect to low-sulfur fuels.

Another way to improve fuel economy is to reduce engine friction.

SUMMARY OF THE DISCLOSURE

In an aspect, there is disclosed a low-sulfur middle distillate fuel composition comprising:

a friction modifying effective amount of a hydrocarbyl-substituted succinimide; and a low-sulfur middle distillate fuel.

There is also disclosed a method for modifying friction in a compression engine comprising providing to the engine a middle distillate fuel comprising a friction-modifying effective amount of a hydrocarbyl-substituted succinimide.

Further, in another aspect, there is disclosed a method for improving fuel mileage in a vehicle comprising providing to the vehicle a middle distillate fuel comprising a friction-modifying effective amount of a hydrocarbyl-substituted succinimide.

Additional objects and advantages of the disclosure will be set forth in part in the description which follows, and/or can be learned by practice of the disclosure. The objects and advantages of the disclosure will be realized and attained by means of the elements and combinations particularly pointed out in the appended claims.

It is to be understood that both the foregoing general description and the following detailed description are exemplary and explanatory only and are not restrictive of the disclosure, as claimed.

DESCRIPTION OF THE EMBODIMENTS

As used herein the term "succinimide" is meant to encompass the completed reaction product from reaction between ammonia and a hydrocarbyl-substituted succinic acid or anhydride (or like succinic acylating agent), and is intended to encompass compounds wherein the product may have amide, and/or salt linkages in addition to the imide linkage of the type that results from the reaction of or contact with ammonia, and an anhydride moiety. By "reacting" herein with regard to the alkylation is meant the product or result of contacting, exposing or bringing together any of the recited components or chemicals, whether a covalent bond, ionic bond, salt or other association is produced.

The hydrocarbyl-substituted succinimides of the fuels of this disclosure are well known. They are readily made by first reacting an olefinically unsaturated hydrocarbon of a desired molecular weight with maleic anhydride to form a hydrocarbyl-substituted succinic anhydride. Reaction temperatures of about 100° C. to about 250° C. can be used. With higher boiling olefinically-unsaturated hydrocarbons, good results are obtained at about 200° C. to about 250° C. This reaction can be promoted by the addition of chlorine. Alkenyl succinimides in which the succinic group contains a hydrocarbyl substituent containing at least 40 carbon atoms are described for example in U.S. Pat. Nos. 3,172,892; 3,202,678; 3,216,936; 3,219,666; 3,254,025; 3,272,746; 4,234,435; 4,613,341; and 5,575,823, the disclosures of all of which are hereby incorporated by reference.

Typical olefins include, but are not limited to, cracked wax olefins, linear alpha olefins, branched chain alpha olefins, polymers and copolymers of lower olefins. The olefins can be chosen from ethylene, propylene, butylene, such as isobutylene, 1-octane, 1-hexene, 1-decene and the like. Useful polymers and/or copolymers include, but are not limited to, polypropylene, polybutenes, polyisobutene, ethylene-propylene copolymers, ethylene-isobutylene copolymers, propylene-isobutylene copolymers, ethylene-1-decene copolymers and the like.

Hydrocarbyl substituents have also been made from olefin terpolymers. Very useful products can be made from ethylene-$C_{3-12}$ alpha olefin-$C_{5-12}$ non-conjugated diene terpolymers; such as ethylene-propylene-1,4-hexadiene terpolymer; ethylenepropylene-1,5-cyclooctadiene terpolymer; ethylene-propylenenorbornene terpolymers and the like.

In one embodiment, the hydrocarbyl substituents are derived from butene polymers, for example polymers of isobutylene. Suitable polyisobutenes for use in preparing the succinimide-acids of the present disclosure can in one embodiment include those polyisobutenes that comprise at least about 20% of the more reactive methylvinylidene isomer, for example at least 50%, and as a further example at least 70%. Suitable polyisobutenes include those prepared using $BF_3$ catalysts. The preparation of such polyisobutenes in which the methylvinylidene isomer comprises a high percentage of the total composition is described in U.S. Pat. Nos. 4,152,499 and 4,605,808, the disclosures of which are hereby incorporated by reference.

The molecular weight of the hydrocarbyl substituent can vary over a wide range. The hydrocarbyl group can have a molecular weight of less than 600. An exemplary range is about 100 to about 300 number average molecular weight, for example from about 150 to about 275, as determined by gel permeation chromatography (GPC). Thus, hydrocarbyl groups of predominantly $C_4$-$C_{36}$ are useful herein with $C_{14}$-$C_{18}$ hydrocarbyl groups being particularly effective on the succinimide in providing improved lubricity to the low sulfur middle distillate fuel.

Carboxylic reactants other than maleic anhydride can be employed such as maleic acid, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including the corresponding acid halides and lower aliphatic esters.

For example, hydrocarbyl-substituted succinic anhydrides may be prepared by the thermal reaction of a polyolefin and maleic anhydride, as described, for example in U.S. Pat. Nos. 3,361,673 and 3,676,089, the disclosures of which are incorporated by reference. Alternatively, the substituted succinic anhydrides can be prepared by the reaction of chlorinated polyolefins with maleic anhydride, as described, for example, in U.S. Pat. No. 3,172,892, the disclosure of which is incorporated by reference. A further discussion of hydrocarbyl-substituted succinic anhydrides can be found, for example, in U.S. Pat. Nos. 4,234,435; 5,620,486 and 5,393,309, the disclosures of which are incorporated by reference.

The mole ratio of maleic anhydride to olefin unsaturated hydrocarbon can vary widely. It can vary from about 5:1 to about 1:5, for example from about 3:1 to about 1:3, and as a further example the maleic anhydride can be used in stoichiometric excess to force the reaction to completion. The unreacted maleic anhydride can be removed by vacuum distillation.

The reaction between the hydrocarbyl-substituted succinic anhydride and the ammonia can in one embodiment be carried out by mixing the components and heating the mixture to a temperature high enough to cause a reaction to occur but not so high as to cause decomposition of the reactants or products or the anhydride may be heated to reaction temperature and the ammonia added over an extended period. A useful temperature is about 100° C. to about 250° C. Exemplary results can be obtained by conducting the reaction at a temperature high enough to distill out water formed in the reaction.

The hydrocarbyl-substituted succinimide can be present in the middle distillate fuel composition in any desired or effective amount, such as a friction modifying effective amount. In an aspect, the hydrocarbyl-substituted succinimide can be present in an amount ranging from about 10 ppm to about 500 ppm, for example from about 20 ppm to about 300 ppm, and as a further example from about 50 to about 150 ppm by weight, relative to the total weight of the fuel composition.

Middle distillate fuels for use in the disclosed composition include, but are not limited to, jet fuels, diesel fuels, and kerosene. In an aspect, the fuel is a low-sulfur fuel of less than about 50 ppm sulfur, and in another aspect the fuel is an ultra-low sulfur diesel fuel or an ultra-low sulfur kerosene. In one embodiment herein "ultra-low-sulfur" means an amount of sulfur up to about 15 ppm, and in another embodiment the amount of sulfur is less than about 10 ppm. The present disclosure encompasses jet fuels, although these are conventionally not regarded as "low-sulfur" or "ultra-low sulfur" fuels since their sulfur levels can be comparatively quite high. Nevertheless, it has been discovered that jet fuels also benefit from the disclosures and methods herein and thus for purposes of the present disclosure "low-sulfur fuels" and "ultra-low sulfur fuels" herein shall include jet fuels regardless of their sulfur content.

The middle distillate low-sulfur fuel compositions of the present disclosure can contain other additives. Non-limiting examples of additives include dispersants/detergents, antioxidants, thermal stabilizers, carrier fluids, metal deactivators, dyes, markers, corrosion inhibitors, biocides, antistatic additives, drag reducing agents, demulsifiers, emulsifiers, dehazers, anti-icing additives, antiknock additives, anti-valve-seat recession additives, surfactants, other lubricity additives combustion improvers, cetane number improvers and mixtures thereof.

In an aspect, there is disclosed a method for modifying friction in a compression engine comprising providing to the engine a friction-modifying effective amount of the disclosed hydrocarbyl-substituted succinimide. Moreover, there is disclosed herein a method for improving fuel mileage in a vehicle comprising providing to the engine of the vehicle a low-sulfur middle distillate fuel containing a friction-modifying effective amount of a hydrocarbyl-substituted succinimide derived from maleic anhydride and ammonia. One of ordinary skill in the art would understand that "improving fuel mileage" is understood to be as compared to a vehicle utilizing an engine combusting a middle distillate fuel that does not comprise a friction-modifying effective amount of a hydrocarbyl-substituted succinimide derived from maleic anhydride and ammonia. One of ordinary skill in the art would also understand that as friction in a vehicle is thus reduced, then its fuel mileage, and/or fuel economy, is increased. This can be both from introduction of the present succinimide from the fuel into the lubricant of the engine, as well as the direct friction-reducing effect of the succinimide on the piston and cylinder surfaces.

EXAMPLES

Preparation of an Alkenyl Succinic Anhydride

An olefin and maleic anhydride were placed in a stainless steel pressure reactor. Maleic anhydride was present in a 3-5% molar excess (1.03-1.05 maleic anhydride: 1 olefin). A small amount (~200 ppm) of aluminum chloride was also added to reduce tarring during the reaction. The reactor was heated to about 60° C. to melt the maleic anhydride, purged with nitrogen and sealed. The reactants were stirred and heated to 225° C. and held there for 4 hours. The product was transferred to a flask and heated, under vacuum, to 200° C. for one hour to remove any unreacted maleic anhydride.

Preparation of Succinimide

The prepared alkenyl succinic anhydride was stirred and heated to 150° C. in a flask equipped with a nitrogen purge and a Dean-Stark trap. Ammonia was then injected at a slow rate and the temperature was increased to 172° C. Ammonia injection continued until the reaction stopped producing water. Infrared spectroscopy indicated that in all examples, the principal product was alkenyl succinimide.

Table 1 provides a description of the various reactants that were used in the process described above to make the disclosed alkenyl succinimides.

TABLE 1

| Reactants | |
|---|---|
| ADDITIVE EXAMPLE | REACTANTS |
| 1 | "16 ASA" alkenyl succinic anhydride/ammonia |
| 2 | Blend of $C_{16}$-$C_{18}$ alpha olefin/maleic anhydride/ammonia |
| 3 | Blend of $C_{20}$-$C_{24}$ isomerized alpha olefins/maleic anhydride/ammonia |
| 4 | Mixture of isobutylene oligomers ranging from $C_4$-$C_{36}$ (with a peak at $C_{16}$)/maleic anhydride/ammonia |
| 5 | Mixture of isobutylene oligomers ranging from $C_4$-$C_{36}$ (with a peak at $C_{12}$)/maleic anhydride/ammonia |
| 6 | Polyisobutylene (polybutenes with Mn = 220)/maleic anhydride/ammonia |
| 7 | Polyisobutylene (polybutenes with Mn = 370)/maleic anhydride/ammonia |

Additive 1 "16 ASA" is a tradename of Albemarle Corporation and is produced from the reaction of isomerized olefins (primarily $C_{16}$) and maleic anhydride.
Additive 2 employed an olefin obtained from Innovene LLC.
Additive 3 employed an alpha olefin blend obtained from Chevron Phillips.
Additive 4 employed an oligomer blend obtained from Texas Petrochemicals Inc.
Additive 5 employed an oligomer blend obtained from Texas Petrochemicals Inc.
Additive 6 employed a polyisobutylene obtained from Innovene LLC.
Additive 7 employed a polyisobutylene obtained from Innovene LLC.

The alkenyl succinimides prepared above were used to prepare various middle distillate fuel compositions in Table 2. The middle distillate fuel compositions were then subjected to a high frequency reciprocating rig test (ASTM D6079) wherein the average HFRR wear scar diameter was recorded.

The lower the wear scar diameter indicated that the fuel composition had exhibited an improvement in lubricity. The results of the HFRR test are shown in Table 2.

TABLE 2

HFRR (ASTM D6079)

| FUEL | ADDITIVE EXAMPLE | TREAT RATE (mg/liter) | Avg. HFRR Wear Scar Diam. (microns) |
|---|---|---|---|
| A | None | — | 640 |
| A | 1 | 100 | 495 |
| A | 1 | 125 | 458 |
| A | 2 | 100 | 435 |
| A | 3 | 100 | 550 |
| A | 3 | 125 | 470 |
| A | 4 | 100 | 505 |
| A | 5 | 100 | 525 |
| A | 5 | 125 | 435 |
| A | 6 | 100 | 575 |
| A | 7 | 100 | 630 |
| B | None | — | 730 |
| B | 1 | 87 | 460 |
| B | 1 | 108 | 385 |
| C | None | — | 600 |
| C | 1 | 87 | 375 |
| D | None | — | 555 |
| D | 1 | 87 | 480 |
| D | 1 | 108 | 410 |
| E | None | — | 550 |
| E | 1 | 87 | 470 |
| E | 1 | 108 | 425 |

Fuel A = Jet A
Fuel B = #1 Ultra-low sulfur diesel (ULSD) fuel
Fuel C = Ultra-low sulfur kerosene (ULSK)
Fuel D = #2 ULSD Fuel
Fuel E = #1 ULSD Fuel As can be seen from Table 2, the present disclosure provides improved lubricity in the low-sulfur fuel as evidenced by the reduced wear scar result in the HFRR rig test. As the molecular weight of the hydrocarbyl group increases, the benefit in lubricity decreases. The best lubricity results were obtained when the olefin content was about $C_{16}$, as noted in HFRR wear scar values of 435 to 505 at 100 ppm. Thus, additive examples 1, 2 and 4 had peak hydrocarbyl groups of $C_{16}$ and gave excellent HFRR wear scar lubricity results in the various fuels tested.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A low-sulfur middle distillate fuel composition comprising:

from about 50 to about 150 ppm of a hydrocarbyl-substituted succinimide comprising the product of contacting a hydrocarbyl-substituted succinic anhydride and ammonia; and an ultra low-sulfur fuel composition comprising less than 15 ppm sulfur, wherein the hydrocarbyl-substituted succinic anhydride is the product of contacting an olefinic unsaturated hydrocarbon with maleic anhydride, wherein the olefinic unsaturated hydrocarbon has isomerized alpha olefins and a number average molecular weight ranging from about 100 to about 300 as determined by gel permeation chromatography, the olefinic unsaturated hydrocarbon comprising predominantly $C_{16}$ olefins, and wherein the low-sulfur middle distillate fuel composition comprises a sufficient amount of the hydrocarbyl-substituted succinimide to achieve a wear scar having a reduced diameter in a ASTM D6079 HFRR rig test compared to a diameter of a wear scar obtained using the low-sulfur fuel without the hydrocarbyl-substituted succinimide.

2. The fuel composition of claim 1, wherein the fuel is selected from the group consisting of a diesel fuel, kerosene, and jet fuel.

3. The fuel composition of claim 2, wherein the diesel fuel is an ultra-low sulfur diesel fuel.

4. The fuel composition of claim 1, wherein the fuel is an ultra-low sulfur kerosene fuel.

5. The fuel composition of claim 1, wherein the olefinic unsaturated hydrocarbon is linear or branched.

6. A method for modifying friction in a compression engine comprising:

providing to the engine an ultra low-sulfur fuel comprising from about 50 to about 150 ppm of a hydrocarbyl-substituted succinimide comprising the product of contacting a hydrocarbyl-substituted succinic anhydride and ammonia, and operating the compression engine, the low-sulfur middle distillate fuel composition reducing engine friction during operation of the engine compared to the friction that would result using the low-sulfur fuel without the hydrocarbyl-substituted succinimide, wherein the hydrocarbyl-substituted succinic anhydride is the product of contacting an olefinic unsaturated hydrocarbon with maleic anhydride, wherein the olefinic unsaturated hydrocarbon has isomerized alpha olefins and a number average molecular weight ranging from about 100 to about 300 as determined by gel permeation chromatography, the olefinic unsaturated hydrocarbon comprising predominantly $C_{16}$ olefins, and wherein the ultra low-sulfur fuel comprises less than 15 ppm sulfur.

* * * * *